US006435818B1

(12) United States Patent
Gatley, Jr.

(10) Patent No.: US 6,435,818 B1
(45) Date of Patent: Aug. 20, 2002

(54) LOW VIBRATION BLOWER HOUSING AND MOTOR MOUNT

(75) Inventor: William Stuart Gatley, Jr., Cassville, MO (US)

(73) Assignee: Jakel Incorporated, Highland, IL (US)

( * ) Notice: Subject to any disclaimer, the term of this patent is extended or adjusted under 35 U.S.C. 154(b) by 0 days.

(21) Appl. No.: 09/651,643

(22) Filed: Aug. 30, 2000

(51) Int. Cl.[7] ..... F04D 29/66; F04D 29/40

(52) U.S. Cl. ..... 415/119; 415/200; 415/214.1; 415/206

(58) Field of Search ..... 415/119, 206, 415/203, 200, 213.1, 214.1; 417/423.14, 423.15, 312

(56) References Cited

U.S. PATENT DOCUMENTS 348,543 A 12/1969 Earhart
4,607,564 A 8/1986 Stahle et al.
4,865,517 A * 9/1989 Beehler ..... 415/214.1
4,978,281 A * 12/1990 Conger, IV ..... 417/423.15
4,997,342 A * 3/1991 Conger, IV ..... 415/200
5,046,922 A * 9/1991 Nakamura et al. ..... 415/200
5,055,006 A * 10/1991 Kobayashi et al. .... 417/423.14
5,336,046 A 8/1994 Hashimoto et al.
5,443,364 A * 8/1995 Mistry et al. ..... 415/214.1
5,915,922 A * 6/1999 Wiethe et al. ..... 415/214.1
5,954,476 A * 9/1999 Stewart et al. ..... 415/214.1

* cited by examiner

*Primary Examiner*—F. Daniel Lopez
*Assistant Examiner*—Richard Woo

(57) ABSTRACT

A blower housing having a casing with a resilient bottom piece and a rigid top piece assembling with the bottom piece to define an interior of the casing is provided. The bottom piece of the blower housing directly abuts a blower mounting surface. The top piece supports a blower motor. The bottom piece is constructed from a vibration dampening material. The top piece is constructed from a rigid material. The vibration absorbing material attenuates noise and other vibrations transmitted from the blower motor and impeller of the blower housing to the blower mounting surface and other associated structures.

22 Claims, 6 Drawing Sheets

LOW VIBRATION BLOWER HOUSING AND MOTOR MOUNT

BACKGROUND OF THE INVENTION (1) Field of the Invention

The invention relates to blowers for high efficiency furnaces for drawing combustion gases into the furnace and propelling the products of combustion into the exhaust pipe to be vented to atmosphere. More specifically, the invention relates to the construction of the blower housing.

(2) Description of the Related Art

Blowers to which the present invention is directed are common in the art. The blower is used on high efficiency furnaces (e.g. 90%) to draw combustion air into the furnace from outside the home. Generally, these blowers are located downstream of a combustion chamber or combustion tubes in the furnace, depending upon the style of furnace. Combustion air is drawn into the combustion chamber or combustion tubes, mixed with fuel, and ignited to generate heat for the furnace. The exhaust gases are then drawn into the suction of the blower and discharged from the blower to an exhaust pipe that vents to outside atmosphere.

FIG. 1 shows a blower 20 of the prior art arranged on a blower mounting surface 21 of a furnace 22. The blower 20 includes a blower motor (47) and a blower housing 24. In FIG. 1A, the blower motor has been removed from its center mount 26 on top of the blower housing 24 to show greater detail of the blower housing 24. The blower housing 24 has a side wall 28 extending between a top piece 30 and a bottom piece 32. Locator surfaces 33A,33B are provided on the top and bottom pieces 30,32 to align the top and bottom pieces 30,32. The locator surfaces 33A,33B also form a seal between the top and bottom pieces 30,32 to contain exhaust gases within the blower housing 24. The top piece 30 is molded with the center mount 26 recessed to receive the blower motor (not shown). The side wall 28, top piece 30, and bottom piece 32 form a volute 34 for the blower housing 24. When the blower 20 is energized, an impeller (not shown), operably connected to a shaft of the blower motor (not shown), rotates in the volute 34 to draw exhaust gases through an inlet hole 35 in the center of the bottom piece 32 and to compress gases in the volute 34. The pressurized exhaust gases are directed into a discharge pipe 36 that extends outward and away from the blower 20 and the furnace 22. Mounting feet 38 for attaching the blower 20 to the blower mounting surface 21 of the furnace 22 are provided on the side wall 28 of the blower housing 24.

FIG. 1B shows the blower 20 arranged on the blower mounting surface 21 in the furnace 22. The blower housing 24 is positioned to allow the impeller (not shown) to draw exhaust gases directly from the combustion chamber or combustion tubes (not shown) into the blower housing 24. The discharge pipe 36 is coupled to an exhaust pipe 39 using a gasket 40 to vent the exhaust gases to atmosphere. The top piece 30 is attached to the blower mounting surface 21 using mechanical fasteners 41 through holes 42 on the mounting feet 38. The mechanical fasteners 41 have a screw head driving end 43 and an opposite driven end 44 spaced from the driving end 43 by a shaft 45. The screw head driving end 43 engages a seating surface 46 on the mounting foot 38 and holds the top piece 30 onto the blower mounting surface 21. The bottom piece 32 is preferably held in position between the top piece 30 and the blower mounting surface 21 by compression from the mechanical fasteners 41.

Typically, the impeller rotates at a high rate of speed to generate sufficient air flow into the combustion chamber and combustion tubes and to draw the exhaust gases out into the exhaust pipe 39. As shown in FIG. 1B, the blower motor 47 is positioned directly atop of the blower housing 24 and the shaft (not shown) of the blower motor 47 is directly coupled to the impeller (not shown) in the blower housing 24. The high speed rotation of the impeller and the motor 47 tends to create noise and other vibrations that are transferred directly into the blower housing 24. As shown in FIG. 1B, the blower 20 is directly mounted onto the blower mounting surface 21 of the furnace 22. Therefore, noise and vibrations are transmitted directly to the blower mounting surface 21 in the furnace 22. This vibration results in unwanted noise being transmitted into the associated structures of the furnace 22 such as ducting where the noise can be transmitted throughout the house. The vibration also contributes to decreased life span of the blower 20.

In the prior art to combat these problems, the installation of the blower housing onto the furnace mounting surface generally involved installing cushioning mounts 48 and other vibration absorbing gaskets between the blower housing 24 and the blower mounting surface 21.

What is needed to overcome the disadvantages of the prior art is to form a blower housing which has sound dampening qualities integrally formed in the housing to reduce noise and vibration transmitted from the motor and impeller into the blower mounting surface. Such a blower housing would have the vibration absorbing material integrally formed in the housing so that gaskets and other additional cushioning devices are not needed. Moreover, such a blower housing would be sufficiently sturdy to withstand high temperature exhaust gases passing through it.

SUMMARY OF THE INVENTION

In order to overcome the disadvantages of the prior art, the blower of the present invention includes a blower housing having a resilient bottom piece and a rigid top piece covering over the bottom piece to enclose an interior of the blower housing. The bottom piece of the blower housing directly abuts the exterior mounting surface of the furnace. The top piece of the blower housing supports the blower motor.

The bottom piece of the blower housing may be made from a vibration dampening material. Materials such as sanoprene and viram are suitable for dampening and attenuating vibrations and withstanding the heat from the products of combustion. The top piece of the blower housing may be made from a material such as polypropylene to provide a rigid foundation for the blower motor and for material compatibility the bottom piece.

The top piece of the blower housing includes an annular lower support portion for supporting the blower motor and an annular upper portion extending above and around the lower portion. The upper portion of the top piece of the blower housing has an outer peripheral edge and at least one lug extending outward beyond outer peripheral edge. The bottom piece of the blower housing has a flange that aligns with the lug of the top piece when the blower housing is assembled. The flange interlocks with the lug to detachably engage the top piece to the bottom piece. The top piece, side wall and bottom piece form a volute for the blower housing.

The lug on the top piece has a lug hole to receive a mechanical fastener. The flange on the bottom piece preferably has a flange hole that receives the mechanical fastener therethrough when the mechanical fastener joins the top piece to the blower mounting surface of the furnace. The mechanical fastener preferably attaches the blower housing to a blower mounting surface of the furnace such that the blower housing is positioned between a blower motor and exterior mounting surface of the furnace. The mechanical fastener has a driven end and a driving end. The driven end is inserted into the blower mounting surface of the furnace and the driving end is located above the lug on the upper portion of the top piece.

In another aspect of the present invention, the blower housing is provided with an improved seal between the top and bottom pieces. Preferably, the blower housing includes a bottom piece having a disk shaped bottom portion with an outer perimeter border. The bottom piece has an upstanding annular wall extending outward from the bottom disk around the outer perimeter border. The upstanding annular wall has an interior surface that forms a portion of the volute for the blower housing and an exterior surface surrounding the interior surface. The upstanding wall has an annular end axially opposite the bottom disk portion that extends between the exterior and interior surfaces of the upstanding wall. The annular end has an annular lip axially spaced from the annular end.

The top piece fits over the bottom piece to enclose the volute and form a casing for the blower. The top piece has a lower portion recessed into the top piece and extending into the casing. The lower portion receives the blower motor. The top piece has an upper portion which extends around and above the lower portion. The upper portion has a primary groove and an outer peripheral edge surrounding the primary groove. The primary groove has an annular outer side wall and an annular inner side wall spaced apart by an annular groove wall. The groove wall preferably has a secondary groove intermediate the coterminous edges of the groove wall and inner and outer side walls. The inner side wall of the primary groove abuts the interior surface of the upstanding wall of the bottom piece and the annular lip of the bottom piece is received in the secondary groove when the casing is assembled.

The inner side wall of the primary groove preferably has an annular rib extending outward from the side wall into the primary groove. The interior surface of the upstanding annular wall preferably has an annular notch on its interior surface. In this arrangement, the annular notch receives the annular rib in the primary groove when the bottom piece is fully assembly with the top piece. This construction provides a positive indicator of sealing between the top and bottom pieces when the blower housing is assembled.

To provide further structural integrity to the top and bottom pieces when the casing is assembled, the lug on the top piece is preferably provided with a depending leg. The depending leg extends downward and away from the outer peripheral edge of the top piece and is received in the flange hole.

The blower housing of the present invention may be installed on a furnace without the use of sound absorbing or other vibration dampening devices. The two piece assembly of the blower housing facilitates assembly of the blower housing and installation of the blower housing onto the furnace mounting surface.

BRIEF DESCRIPTION OF SEVERAL VIEWS OF THE DRAWINGS

Further objects and features of the invention are revealed in the following detailed description of the preferred embodiment of the invention and in the drawings wherein.

Corresponding reference numerals indicate corresponding parts throughout the several views of the drawings.

DETAILED DESCRIPTION OF THE PREFERRED EMBODIMENT

Figure 2:
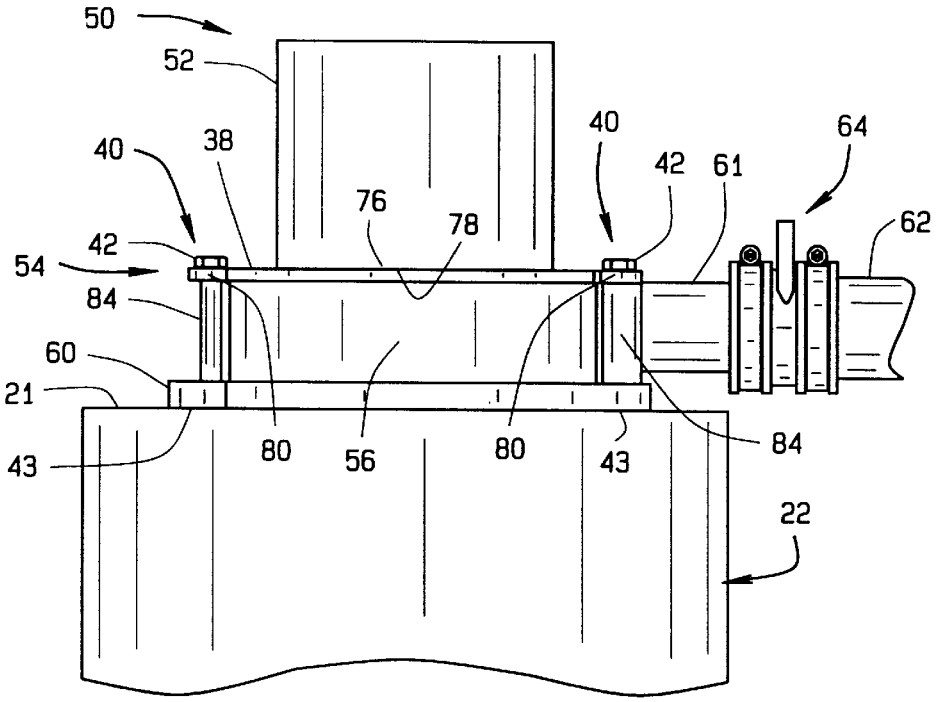
FIG. 2 is a side view of a blower of the present invention installed on the mounting structure of the furnace.

FIG. 2 shows the blower of the present invention installed in a furnace. The blower 50 includes a blower motor 52 and a blower housing 54. The blower housing 54 has an annular upstanding wall 56 extending between a top piece 58 and bottom piece 60. The bottom piece 60 is mounted on a blower mounting surface 21 in the furnace 22, or the furnace bonnet, using mechanical fasteners 41. The driving end 43 of each of the fasteners 41 seats against the top most portion of top piece 58 and the driven end 44 is installed in the blower mounting surface 21 on the furnace 22. In the arrangement shown in FIG. 2, the bottom piece 60 is preferably held in position between the top piece 58 and the blower mounting surface 21 by compression from the mechanical fasteners 41.

As shown in FIG. 2, the blower 50 is mounted on a blower mounting surface 21 on the furnace 22 where the blower housing 54 is positioned to allow the impeller (not shown) to draw exhaust gases directly from the combustion chamber or combustion tubes (not shown) into the blower housing 54. A discharge pipe 61 is coupled to an exhaust pipe 62 using a gasket 64 to vent the exhaust gases to atmosphere.

Figure 3:
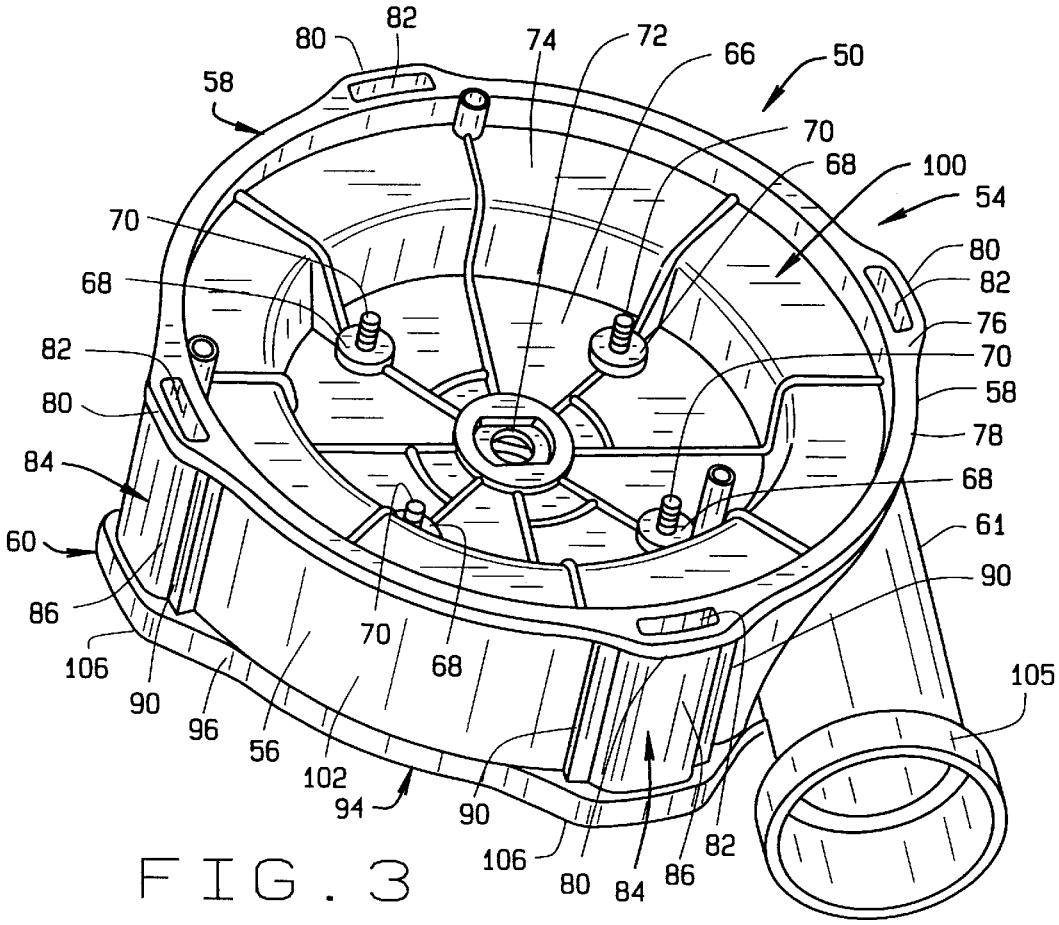
FIG. 3 is a perspective view of a blower housing of the blower of FIG. 2.

FIG. 3 shows a perspective view of the blower housing 54 with top piece assembled on the bottom piece 60. The top piece 58 covers over the bottom piece 60 to tightly enclose the blower housing 54 and prevent exhaust gases from leaking from the blower housing 54 during operation. The top piece 58 has a lower portion 66 that is recessed into the top piece 58 and extends into the blower housing casing 54. The diameter of the recessed lower portion 66 is sized to accommodate the blower motor 52. The lower portion 66 has mounting fittings 68 for securing the blower motor to the top piece 58. The lower portion 66 may also have screw fittings 70 for securing the motor to the top piece 58. At the center of the lower portion 66, a through hole 72 is provided to allow a shaft (not shown) from the blower motor to pass into the interior of the blower housing 54 to be coupled with the impeller (not shown). The top piece 58 has an upper portion 74 which extends around and above the lower portion 66 and includes a seating surface 76 for the mechanical fasteners 41.

Figure 4:
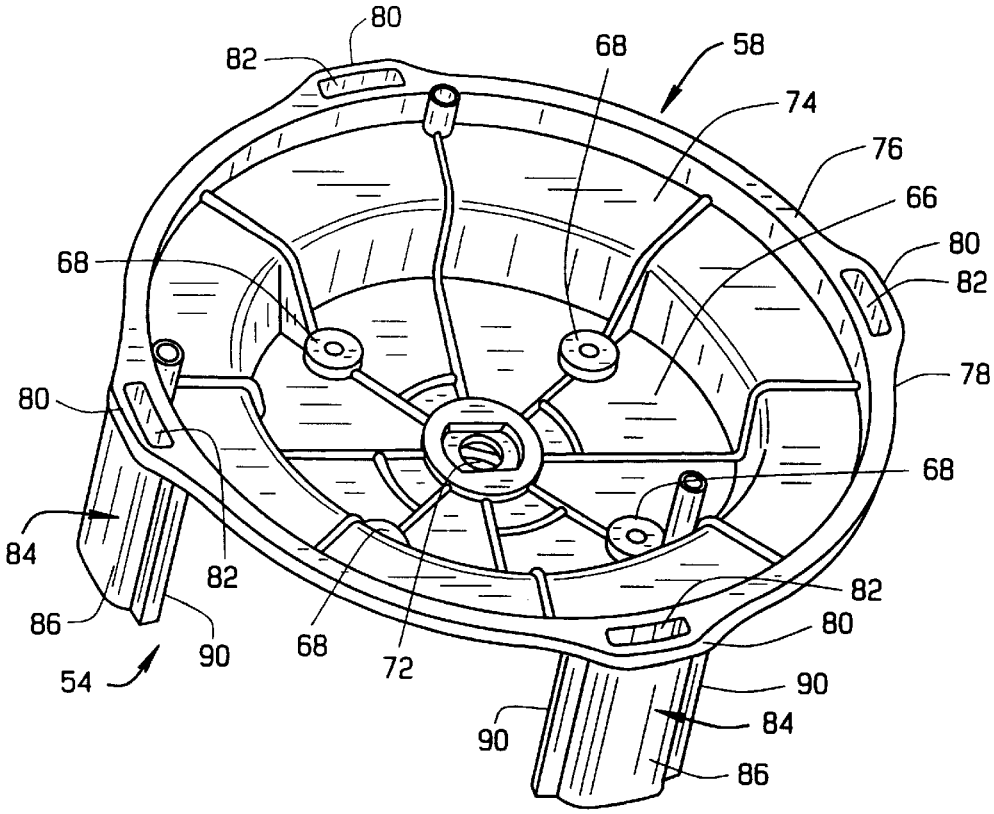
FIG. 4 is a top, perspective view of a top piece of the blower housing of FIG. 3.
Figure 5:
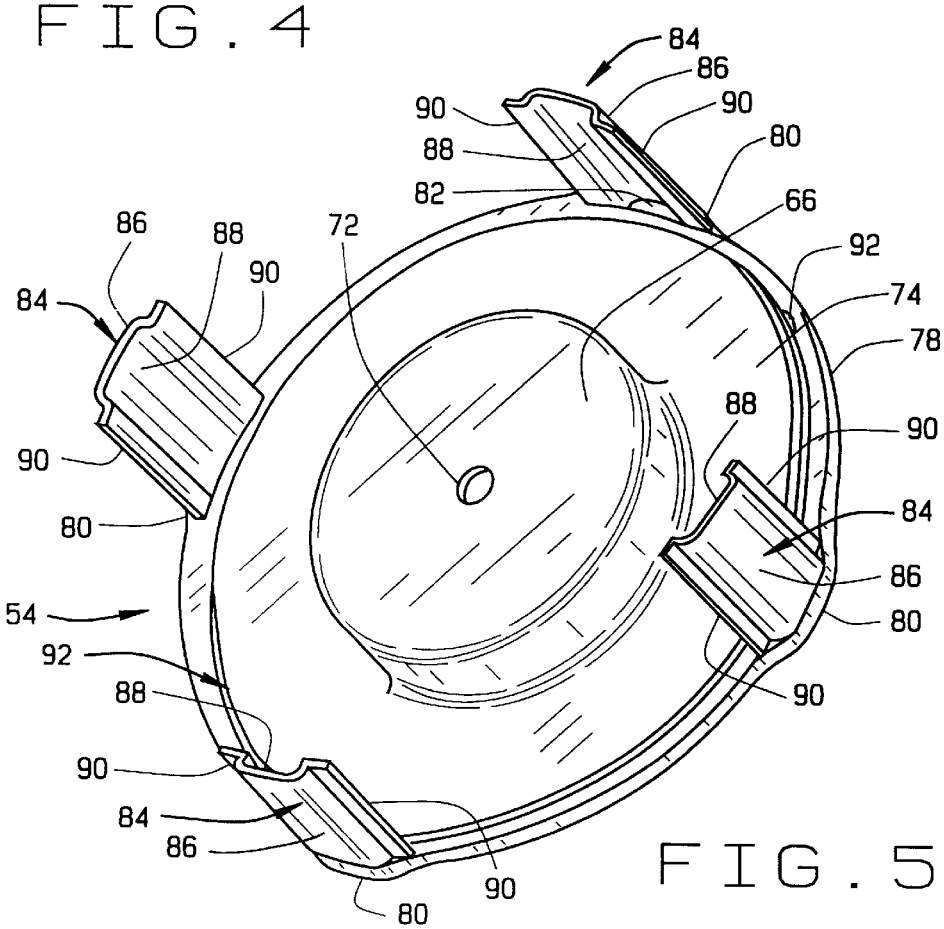
FIG. 5 is a bottom, perspective view of the top piece of FIG. 4.

FIGS. 4 and 5 provide greater detail of the top piece 58. The upper portion 74 of the top piece 58 has an outer peripheral edge 78 and lugs 80 extending radially outward beyond the outer peripheral edge 78. The lugs 80 preferably have arcuate lug holes 82 formed therein to allow minor positioning of the blower housing 54 on the blower mounting surface 21 of the furnace 22 when the blower 50 is installed on the furnace 22. Preferably, each of the lugs 80 has a depending leg 84 extending downward and away from the outer peripheral edge 78 of the top piece 58. Each leg 84 preferably has an exterior surface 86 and an arcuate interior surface 88 which gives each leg 84 a generally concave aspect when it is installed on the blower housing 54. The arcuate interior surface 88 of the depending leg 84 preferably has a circumferential guide portion 90 that conforms to the upstanding annular wall 56 on the bottom piece 60. The circumferential guide portion 90 on the depending leg 84 supports and aligns the top piece 58 with the bottom piece 60 during operation. The depending leg 84 bears some of the weight of the blower motor when the blower 50 is installed on the blower mounting surface 21 of the furnace 22.

As shown in FIG. 5, an annular locating groove 92 is provided around the upper portion 74 radially inward of the outer peripheral edge 78. The annular locating groove 92 is positioned a sufficient distance away from the outer peripheral edge 78, lug hole 82, and depending leg 84 to so as not to interfere with the seal between the top piece 58 and bottom piece 60 when the blower housing 54 is assembled. Greater detail of the annular locating groove 92 and seal between the top and bottom pieces 58,60 will be discussed later with reference to FIG. 8.

Figure 6:
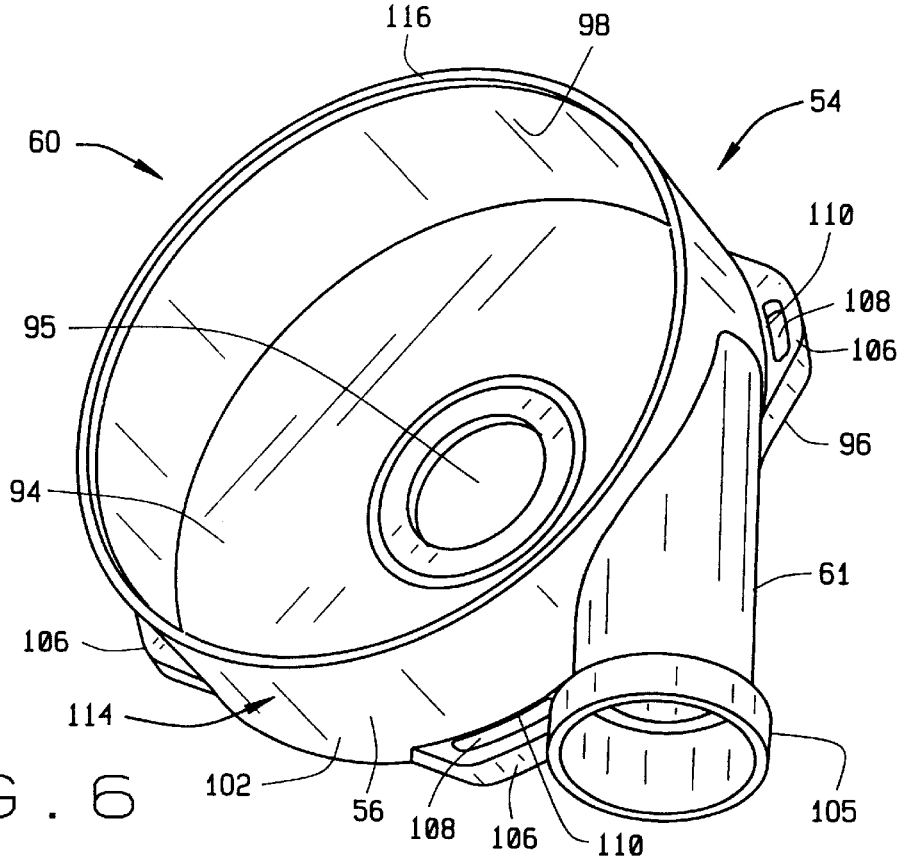
FIG. 6 is a top, perspective view of a bottom piece of the blower housing of FIG. 3.
Figure 7:
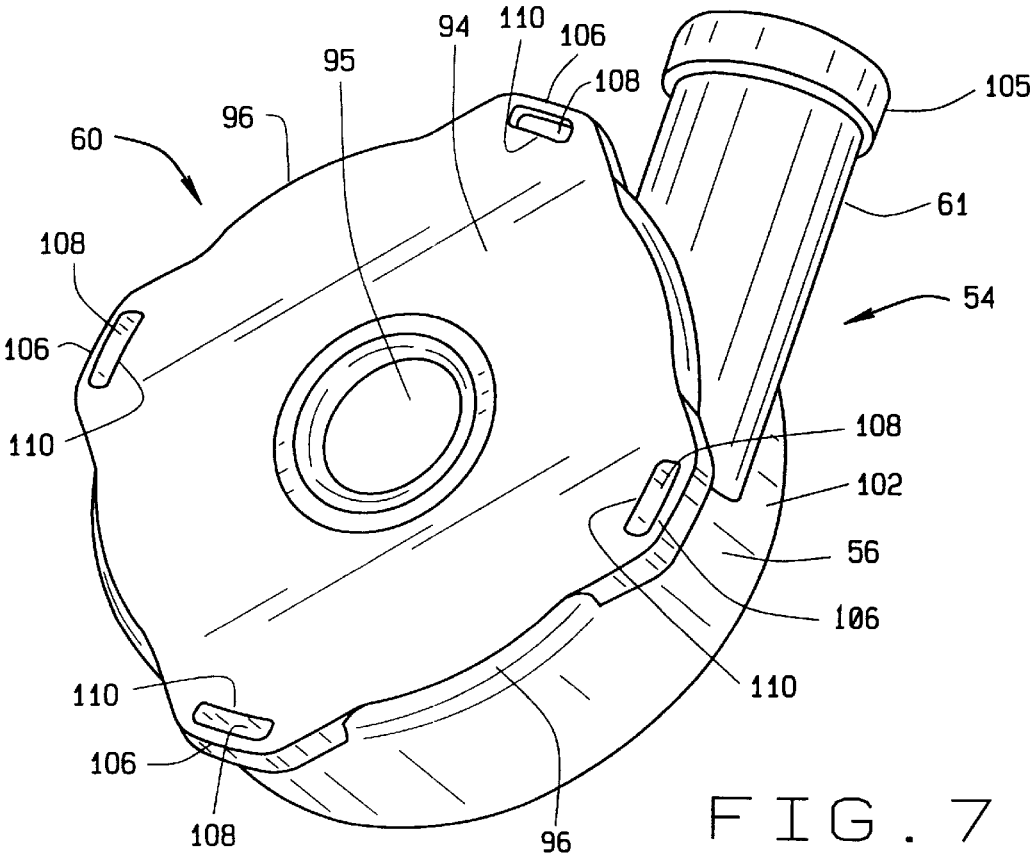
FIG. 7 is a bottom, perspective view of the bottom piece of FIG. 6.

FIGS. 6 and 7 provide detail of the bottom piece 60 of the blower housing 54. The bottom piece 60 has a bottom disk portion 94 with a center inlet hole 95 that allows the blower 50 to draw exhaust gases into the housing 54 during blower operation. The bottom disk portion 94 has an outer perimeter border 96 and the upstanding annular wall 56 extends outward and away from the outer perimeter border 96. The underside of the bottom disk portion 94 of the blower housing 54 is generally flat so that it may be mounted flush against the blower mounting surface 21 of the furnace 22. The upstanding annular wall 56 has an interior surface 98 which defines a portion of a volute 100 of the blower housing 54 and an exterior surface 102 that surrounds the interior surface 98. The discharge pipe 61 extends outward and away from the annular wall 56 and communicates with the volute 100 to direct pressurized exhaust gases from the blower housing 54. The discharge pipe 61 may have a boss end 105 to allow connection to the exhaust pipe 62, as required. Preferably, the bottom disk portion 94, the upstanding wall 56, and the discharge pipe 61 are formed monolithically.

The bottom piece 58 is provided with a plurality of mounting flanges 106 circumferentially spaced around the outer perimeter border 96 of the bottom disk portion 94. Each of the mounting flanges 106 extends radially outward from the outer perimeter border 96 and has a flange hole 108 therethrough. Each of the mounting flanges 106 preferably aligns with a corresponding lug 80 on the top piece 58. The alignment of the lugs 80 and flanges 106 may be such that the top piece 58 and bottom piece 60 are assembled in only one orientation. Similar to the lug hole 82, the flange hole 108 is also preferably arcuate to allow minor adjustment of the blower 50 when the blower 50 is mounted on the blower mounting surface 21 of the furnace 22. To maximize the diameter of the upstanding annular wall 56, an inner edge 110 of the flange hole 108 may be formed flush with the exterior surface 102 of the upstanding annular wall 56.

Figure 9:
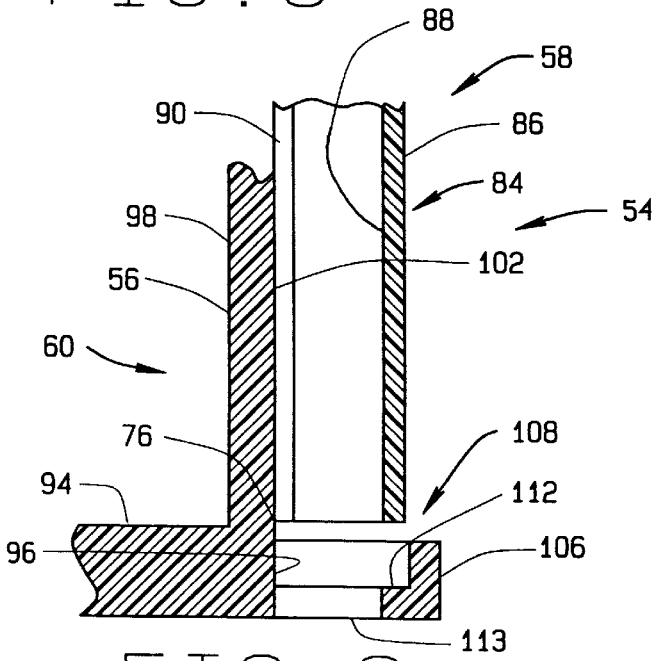
FIG. 9 is a cross-sectional view of the top piece installed with the bottom piece to form the blower housing of FIG. 3.

Preferably, the flange hole 108 is also formed to receive the depending leg 84 of the top piece 58 when the blower 50 is assembled. As shown in FIG. 9, the flange hole 108 preferably has a step recess 112 which is shaped to receive the depending leg 84 from the lug 80 of the top piece 58 and a through hole 113. The through hole 113 allows the mechanical fastener to be directed from the lug 80 and lug hole 82 on the top piece 58 to the blower mounting surface 21 on the furnace 22 when the blower 50 is secured to the blower mounting surface 21 on the furnace 22. The step recess 112 positively aligns the depending leg 84 and captures a bottom portion of the circumferential guide portion 90 of the depending leg 84 so that the top piece 58 and bottom piece 60 remain positively engaged during operation of the blower 50. It is preferred that the bottom piece 60 be held in position by the compressive forces exerted by the mechanical fastener 40 on the top piece 58. The step recess 112 bears some of this compressive force and stabilizes the position of the bottom piece 60 adjacent the blower mounting surface 21 of the furnace 22.

Figure 8:
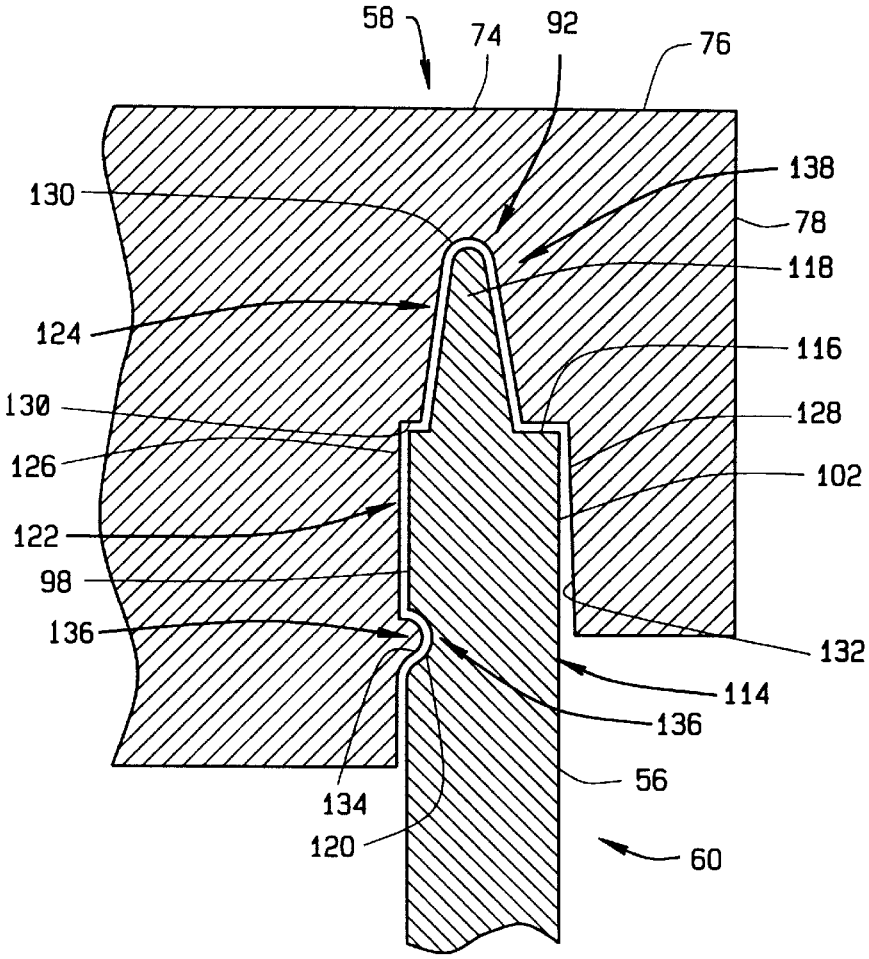
FIG. 8 is a cross-sectional view of the top piece installed with the bottom piece to form the blower housing of FIG. 3.

Details of the attachment between the top and bottom pieces are best shown in FIG. 8. The upstanding annular wall 56 of the bottom piece 60 has an upper section 114 that cooperates with the annular groove 92 in the upper portion 74 of the top piece 58. The upper section 114 includes an annular end 116 that extends between the interior and exterior surfaces 98,102 of the upstanding wall 56. The annular end 116 has a lip 118 extending axially outward from the bottom disk portion 94 intermediate the coterminous edges of the annular end 116 and the interior and exterior surfaces 98,102 of the upstanding annular wall 56. Preferably, the annular lip 118 has a triangular shaped cross section to allow a locking-type fit between the top and bottom pieces 58,60. The upper section 114 also includes an annular notch 120 extending around the interior surface 98 of the upstanding wall 56.

The annular groove 92 formed in the upper portion 74 of the top piece 58 includes a primary groove 122 and a secondary groove 124. The primary groove 122 includes an annular inner side wall 126 and an annular outer side wall 128 spaced apart from the annular inner side wall 126 by an annular groove wall 130. When the top piece 58 is installed on the bottom piece 60, the annular inner side wall 126 abuts the interior surface 98 of the upstanding annular wall 56, and the annular outer side wall 128 faces the exterior surface 102 of the upstanding annular wall 56. The annular outer side wall 128 may be formed with a lead-in taper 132 to allow the top and bottom pieces 58,60 to more easily fit together.

The primary groove 122 also includes an annular rib 134 axially spaced below the annular groove wall 130. The annular rib 134 cooperates with the annular notch 120 in the upstanding annular wall 56 of the bottom piece 58 to form a first sealing area 136 for the blower housing 54. When the top piece 58 is fully installed on the bottom piece 60, the top piece 58 will snap fit onto the bottom piece 60 as the annular rib 134 slides across the interior surface 98 of the upstanding annular wall 56 and into the annular notch 120. The rib 134 and notch 120 provide a positive lock indication for a blower assembly operator when assembling the blower housing 54 during manufacture.

The secondary groove 124 in the annular groove 92 on the upper portion 74 of the top piece 58 is formed internal to primary groove 122. The secondary groove 124 is formed intermediate the coterminous edges of the annular groove wall 130 and inner and outer side walls 126,128. The secondary groove 124 has a triangular shaped cross section that matches the geometry of the annular lip 118 on the upstanding wall 56 of the bottom piece 60. The secondary groove 124 provides a secondary sealing area 138 for the blower housing.

In assembling the blower housing 54 into the arrangement shown in FIG. 3, the top piece 58 may be installed with the bottom piece 60 to create the blower housing 54 of the present invention. The upper section 114 of the annular wall 56 of the bottom piece 60 may be inserted into the annular groove 92 on the underside of the top piece 58 and positively locked in place to seal the blower housing 54.

The depending legs 84 of the lug 80 of the top piece 58 may be inserted into the step recess 112 formed in the flange hole 108 such that the circumferential guide portion 90 of the interior arcuate surface 88 of the depending lug 84 mounts flush against the exterior surface 102 of the upstanding annular wall 56 of the bottom piece 60 and a bottom portion of the leg 84 is nested within the recess 112 of the flange hole 108. Preferably, the lengths of the depending legs 84 are sized such that when the upper section 114 of the annular wall 56 is fully inserted into the annular groove 92 in the top piece 58, the leg 84 is captured by the flange hole 108. The lugs 80 and matching flanges 106 may have irregular angular placement along each of the respective top and bottom pieces 58,60 to provide a keying assembly for the blower housing 54 such that the top and bottom pieces 58,60 may be assembled in only one orientation.

Each of the top and bottom pieces 58,60 may be formed from materials that are capable of withstanding relatively high temperatures from the exhaust gases being expelled from the blower housing 54. To provide vibration dampening capability, the bottom piece may be made from viram or sanoprene. The top piece of the blower housing may be constructed from a polypropylene material that is sufficiently rigid and sturdy to prevent deformation under the weight of the blower motor during high temperature operation. Polypropylene is sufficiently rigid and does not require any stiffening panels as might be otherwise required should the entire blower housing itself be made from a rubber material. The polypropylene is also sufficiently rigid to prevent misalignment of the impeller during high temperature operation of the blower and furnace.

Figure 1:
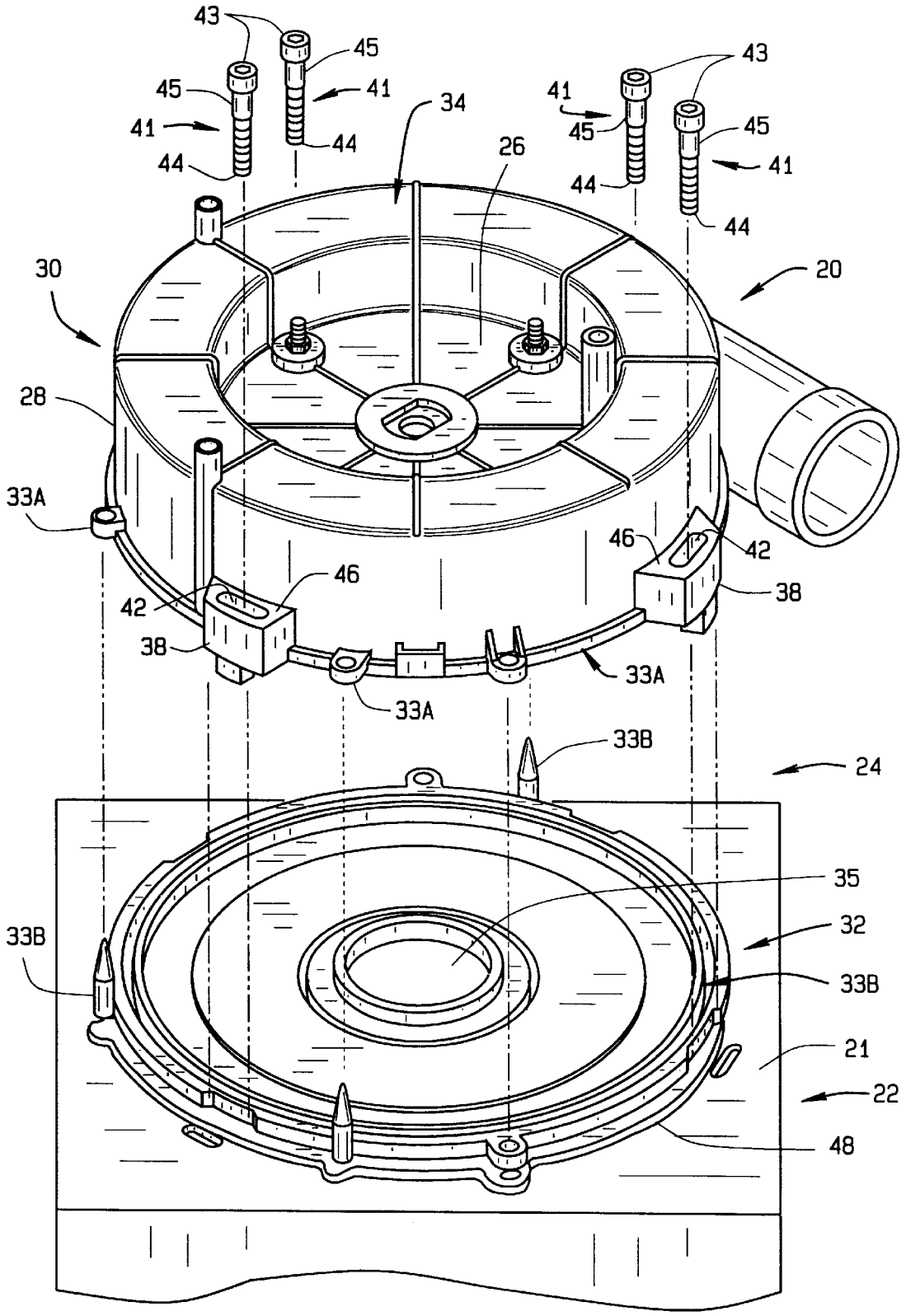
FIG. 1 PRIOR ART
FIG. 1 is an exploded, perspective view of a blower of the prior art.
Figure 1B:
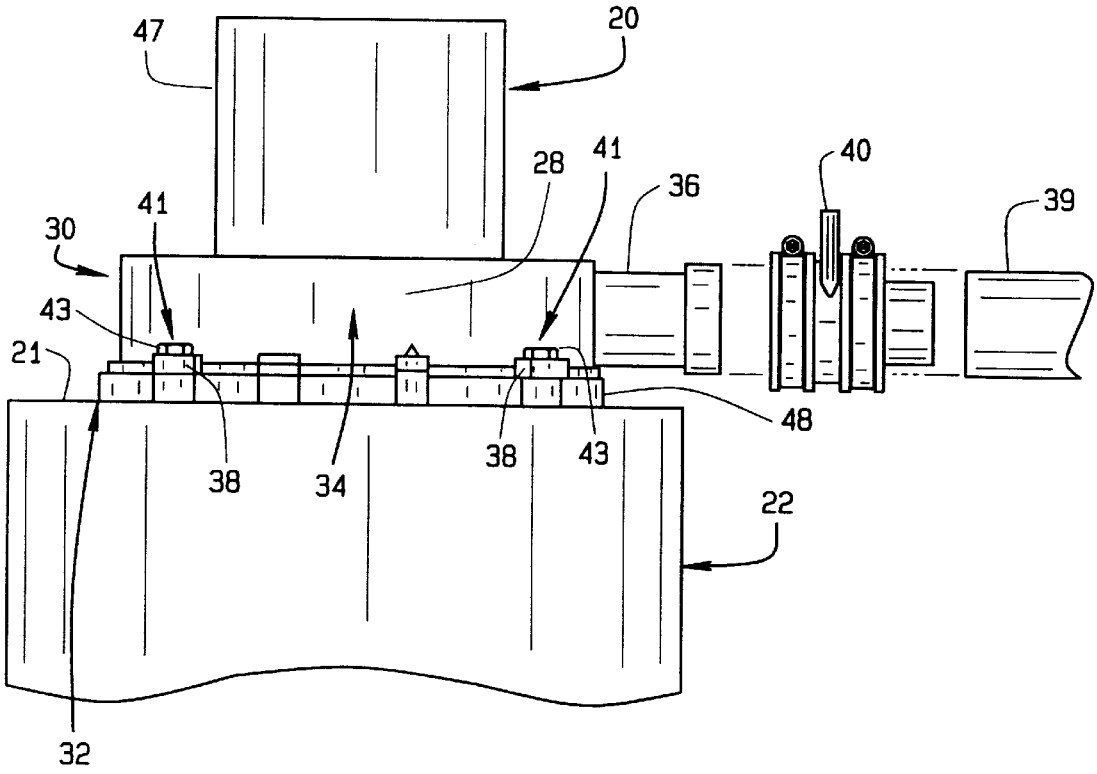
FIG. 1B PRIOR ART
FIG. 1B is a side view of the blower of the prior art installed on a mounting structure of a furnace.

Although the Figures shows the bottom piece formed with the upstanding wall and discharge pipe extending from the upstanding wall, the top piece may be formed with an upstanding wall and the discharge pipe extending from the upstanding similar to blower housing shown in FIG. 1A. Similarly, each of the top and bottom pieces may have a portion of the upstanding wall and a portion of the discharge pipe formed therein. The primary consideration for forming the bottom piece is to provide vibration dampening material between the motor and impeller and the blower mounting surface of the furnace. The bottom piece must also be constructed in such a way to resist deformation by the weight of the motor during high temperature operation so that the radial clearance between the impeller and the bottom piece is maintained.

As is apparent to those skilled in the art, by locating the lugs 80 on the upper portion 74 of the blower housing 54, the diameter of the upstanding annular wall 56 can be increased. By moving the driving end 42 of the mechanical fastener 40 above the lug 80 on the top piece 58, the clearance between the screw head driving end 42 and the upstanding annular wall 56 of the blower housing 50 can be eliminated. The mechanical fastener 40 used to secure the blower housing to the blower mounting surface of the furnace may run directly down the exterior surface 102 of the upstanding annular wall 56 because there is sufficient clearance on the upper portion 74 of the top piece 58 for the screw head driving end 42 of the mechanical fastener 40.

Additionally, since the top piece 58 snap fits with the bottom piece 60 to create a sealed unit, the blower housing more effectively contains exhaust gases. By locating the lugs 80 on the outer peripheral edge 78 of the upper portion 74 of the top piece 58, the upper portion 74 of the top piece 58 may flex inward such that the normally tapered outer side wall 128 of the primary groove 122 contacts the exterior surface 102 of the upstanding wall 56. Thus, the combination of the primary seal 136 and internal secondary seal 138 provides improved sealing characteristics for the blower housing 54 not found in the prior art.

Although the description of the blower housing presented herein refers to a primary and secondary seals formed on respective portions of the top and bottom pieces, it should be noted that the location and combination of the components comprising the primary and secondary seals may reversed and positioned on the other of the top and bottom pieces of the blower housing.

By constructing the bottom piece of the blower housing with a sound dampening material, excessive noise and vibration being transmitted by the blower motor and impeller is dampened and attenuated before reaching the blower mounting surface of the furnace. This prevents the noise from being transmitted into associated duct work throughout the house. The lower noise and vibrations increases the life of the blower.

Various other changes to the preferred embodiment of the invention described above may be envisioned by those of ordinary skill in the art. However, those changes and modification should be considered as part of the invention which is limited only by the scope of the claims appended hereto and their legal equivalents.

What is claimed is:

1. A gas moving system comprising:

a gas chamber structure having an blower mounting surface;

a blower motor; and a blower housing having a resilient bottom piece and a rigid top piece assembling with the bottom piece to define an interior of the blower housing, the interior of the blower housing having an impeller for moving gases, the bottom piece of the blower housing directly abutting the blower mounting surface of the gas chamber structure, the top piece supporting the blower motor.

2. The gas moving system of claim 1, wherein:

the bottom piece of the blower housing includes the volute and the discharge pipe.

3. The gas moving system of claim 2, wherein:

the volute and discharge pipe are monolithically formed with the bottom piece of the blower housing.

4. The gas moving system of claim 1, wherein:

the bottom piece is made from one of the group consisting of sanoprene, and viram, and the top piece is made from polypropylene.

5. The gas moving system of claim 1, wherein:

the bottom piece dampens vibration from the blower motor and impeller.

6. The gas moving system of claim 5, wherein:

the bottom piece limits the vibrations from being transmitted to the gas chamber structure.

7. The gas moving system of claim 1, wherein:

the top piece and bottom piece of the blower housing are keyed to allow assembly of the top and bottom pieces in a single configuration.

8. The gas moving system of claim 1, wherein:

one of the top piece and bottom piece has an annular groove and the other of the top piece and bottom piece has a matching sealing surface that cooperates with the groove, the annular groove receives the sealing surface when the top piece is assembled with the bottom piece to enclose the interior of the blower housing.

9. The gas moving system of claim 1, wherein:

one of the top piece and bottom piece has a lug located on its outer periphery and the other of the top piece and bottom piece has a matching flange located on its outer periphery, the flange and lug are adapted to detachably engage together when the top piece is installed on the bottom piece.

10. The gas moving system of claim 1, wherein:

the lug has a lug hole therethrough to receive a mechanical fastener, the mechanical fastener attaches the blower motor directly to the blower mounting surface of the gas chamber structure with the top and bottom pieces arranged between the blower mounting surface of the gas chamber and the blower motor.

11. A blower housing comprising:

a casing having a bottom piece with an upstanding wall and a discharge pipe and a top piece attaching to the bottom piece and covering over the upstanding wall to seal the casing, the bottom piece being made of a vibration absorbing material, the top piece being made of a rigid material.

12. The blower housing of claim 11, wherein:

the bottom piece is made from one of the group consisting of sanoprene and viram, and the top piece is made from polypropylene.

13. The blower housing of claim 11, wherein:

the top piece and bottom piece of the casing are keyed to allow assembly of the top and bottom pieces in a single configuration.

14. The blower housing of claim 11, wherein:

one of the top piece and bottom piece has a plurality of lugs located on its outer periphery and the other of the top piece and bottom piece has a plurality of matching flanges located on its outer periphery, each of the flanges has a hole therethrough that is adapted to receive its respective lug when the casing is assembled.

15. The blower housing of claim 11 further comprising:

an annular groove on the top piece being configured to receive a portion of the upstanding annular wall when the casing is assembled.

16. A blower comprising:

a casing having a resilient bottom piece and a rigid top piece assembling with the bottom piece to define an interior of the casing, the casing having a volute and a discharge pipe and the interior of the casing having a impeller to compress gas against the volute and direct the gas into the discharge pipe; and a motor being supported by the top piece and operably driving the impeller.

17. The blower of claim 16 further comprising:

an annular upstanding wall extending axially outward from the bottom piece of the casing, the annular upstanding wall having the discharge pipe extending outward therefrom.

18. The blower of claim 16, wherein:

the upstanding wall and the discharge pipe are monolithically formed with the bottom piece.

19. The blower of claim 18, wherein:

the bottom piece is made from one of the group consisting of rubber, sanoprene, and viram, and the top piece is made from polypropylene.

20. The blower of claim 16, wherein:

the bottom piece dampens vibration from the motor and impeller.

21. The blower of claim 19, wherein:

the top piece and bottom piece of the casing are keyed to allow assembly of the top and bottom pieces in a single configuration.

22. The blower of claim 16, wherein:

the casing has external lugs with lug holes therethrough on its outer periphery; and the top piece is connected directly to an external device by mechanical fasteners that pass through the lug holes whereby the bottom piece is positioned between the top piece and the external device.

* * * * *